US006158055A

United States Patent [19]

Park

[11] Patent Number: 6,158,055

[45] Date of Patent: Dec. 12, 2000

[54] CAP WITH PROTRUSIVE EFFECT

[75] Inventor: Boo Yl Park, Seoul, Rep. of Korea

[73] Assignee: Dada Corp., Seoul, Rep. of Korea

[21] Appl. No.: 09/460,515

[22] Filed: Dec. 14, 1999

[51] Int. Cl.[7] ..... A42B 1/00

[52] U.S. Cl. ..... 2/195.1; 2/175.1; 112/439

[58] Field of Search ..... 2/175.1, 195.1, 2/209.12, 209.13, 181; 112/439; 428/542.2, 906.6

[56] References Cited

U.S. PATENT DOCUMENTS

| | | | |
|---|---|---|---|
| 1,682,474 | 8/1928 | Bergman | 112/439 |
| 4,517,910 | 5/1985 | Jalowsky | 112/439 |
| 4,912,056 | 3/1990 | Olson | 435/263 |
| 5,122,159 | 6/1992 | Olson et al. | 8/401 |
| 5,136,726 | 8/1992 | Kellin et al. | 2/244 |
| 5,199,957 | 4/1993 | Pascoe | 8/478 |
| 5,241,919 | 9/1993 | LaGreca | 112/410 |
| 5,474,577 | 12/1995 | Stoner, Sr. et al. | 8/401 |
| 5,817,393 | 10/1998 | Stahl | 428/104 |
| 5,832,854 | 11/1998 | Lin et al. | 112/475 |
| 5,947,044 | 9/1999 | Lin et al. | 112/475 |
| 5,983,400 | 11/1999 | Kronenberger | 2/209 |

*Primary Examiner*—Bibhu Mohanty

*Attorney, Agent, or Firm*—Jacobson, Price, Holman & Stern, PLLC

[57] ABSTRACT

A cap with protrusive effect that can effectively display letters or diagrams of logos, emblems, etc. in a three dimensional fashion. The headwear includes a multi-panel crown, and a crown front portion consisting of two fabric pieces or two fabric pieces and one piece of woven or non-woven material. A flexible molded material or a piece of sheet is used to create letters or diagrams to be used as logos, emblems, etc. and is attached to the crown front portion and upper bill portion. The fabric materials that can be used are any type of common textile fabric or stretchable fabric material. Through a washing process, a natural three dimensional visual effect is provided to maximize the advertising effect of the cap. In addition, a dyed fabric with black pigment coating is used so that when the cap is washed the black pigment is decolorized and a mixed color contrast is provided between the remaining black color and the original color of the dyed fabric to maximize the aesthetic value and effect of a cap.

26 Claims, 3 Drawing Sheets

CAP WITH PROTRUSIVE EFFECT

BACKGROUND OF THE INVENTION

1. Field of the Invention

The present invention relates generally to an improved headwear structure of the type having a crown and an associated depending bill and, more particularly to a cap with an emblem or other mark defined by attaching a flexible molded material or a piece of sheet to produce a protrusive effect, and through a washing process, the attachment portion decolorized to enhance the protrusive effect and to improve the natural appearance of a cap.

2. Background Art

The traditional headwear comprises a plurality of panels forming a crown body, with a bill portion extending therefrom. As a cap is one of the most widely worn pieces of headwear, the front portion of the crown is widely used to display advertisements, logos, emblems, messages, etc. Heretofore, advertisements, logos, emblems, messages, etc. have been attached to the crown surface by embroidery. When a protrusive effect was desired, two or more layers of embroidery were formed on top of a flat embroidery surface. This method however, made the stitching process more difficult as the embroidery layers became higher, decreasing productivity and increasing the embroidery thread required. To provide a solution to this problem, flexible or semi-flexible sheet materials were molded in the shape of the letters or diagrams needed and were attached to a predetermined location. A protrusive effect was achieved by embroidering on top of the attached preformed letters or diagrams. Recently, a method of using a piece of sheet instead of preformed letters or diagrams to stitch the desired letters or diagrams with embroidery thread and removing the remaining parts of a sheet thereafter was employed. In U.S. Pat. No. 5,832,854, Chien-Lu Lin, a piece of sheet is stitched with embroidery thread according to the desired shape with the remaining parts of a sheet removed as the needle passes through so that a protrusive effect is achieved by a sheet remaining on the inside of the embroidery.

However, the above mentioned method only provided a protrusive effect created by the embroidery thread. No attempt has been made to date to coordinate a method of presenting a cap displaying a natural three dimensional visual effect increasing the value and advertising effect of a cap.

SUMMARY OF THE INVENTION

Therefore, the present invention has its principal objective in providing a flexible molded material or a piece of sheet not on the external surface but on the internal surface of the crown portion, to decolorize the protruding fabric material surrounding the molded flexible material through a process of washing so that compared to the surrounding flat surface a more natural protrusive effect is provided.

Another object of the present invention is to move away from the traditional method of limiting the three dimensional effect only to the crown portion by also attaching a flexible molded material or a piece of sheet on the bill portion therefore providing an aesthetically pleasing cap with an increased advertising effect.

A further object of the present invention is to provide a headwear piece constructed of a dyed fabric coated on one side with black pigment. When the cap is put through a washing process the black pigment coating decolorizes displaying a mixed color contrast between the black color remaining and the original color of the fabric producing not only an aesthetically pleasing appearance but also increasing the three dimensional visual effect and value of a cap.

In order to accomplish the foregoing objects, the present invention provides a cap comprising a plurality of panels forming a crown body of which the panels where the letters or diagrams are attached are comprised of two fabric layers, or two fabric layers and one woven or non-woven layer in between the two fabric layers. The upper bill portion is also comprised of one or two fabric layers. A sweatband is attached to the lower periphery of the crown portion. A flexible molded material or a piece of sheet is used to provide a three dimensional visual effect. The molded material is attached to the crown front portion and the upper bill portion. Through a washing process, the protruded fabric surrounding the molded material becomes more decolorized compared to the surrounding flat surfaces, providing a cap with a natural three dimensional visual effect.

In another preferred embodiment of the present invention, a dyed textile fabric coated with black pigment on one side, is used to form a plurality of crown panels. Of the plurality of panels, the front panel to which the molded material is attached comprises two fabric layers, or two fabric layers and one woven or non-woven layer in between the two fabric layers. The upper bill portion is also comprised of one or two fabric layers. A sweatband is attached to the lower periphery of the crown portion. To provide a three dimensional visual effect a three dimensional embroidery stitch including a flexible molded material or perforated sheet is used on the front panel of the crown portion and upper bill portion attaching the molded letters or diagrams. The black pigment coating on the fabric material becomes decolorized through a washing process providing a mixed color contrast between the black color remaining and the original color of the fabric maximizing the aesthetic value and the three dimensional visual effect of a cap.

A variety of colors that provide an appropriate contrast effect between the dyed textile fabric and black pigment should be selected to bring out an improved three dimensional aesthetic effect.

BRIEF DESCRIPTION OF THE DRAWINGS

FIG. 2 is a front elevational view of a cap with protrusive effect displaying an increased three dimensional visual effect using two layers of fabric and one layer of woven or non-woven fabric material in between.

DETAILED DESCRIPTION OF THE DRAWINGS

Figure 1:
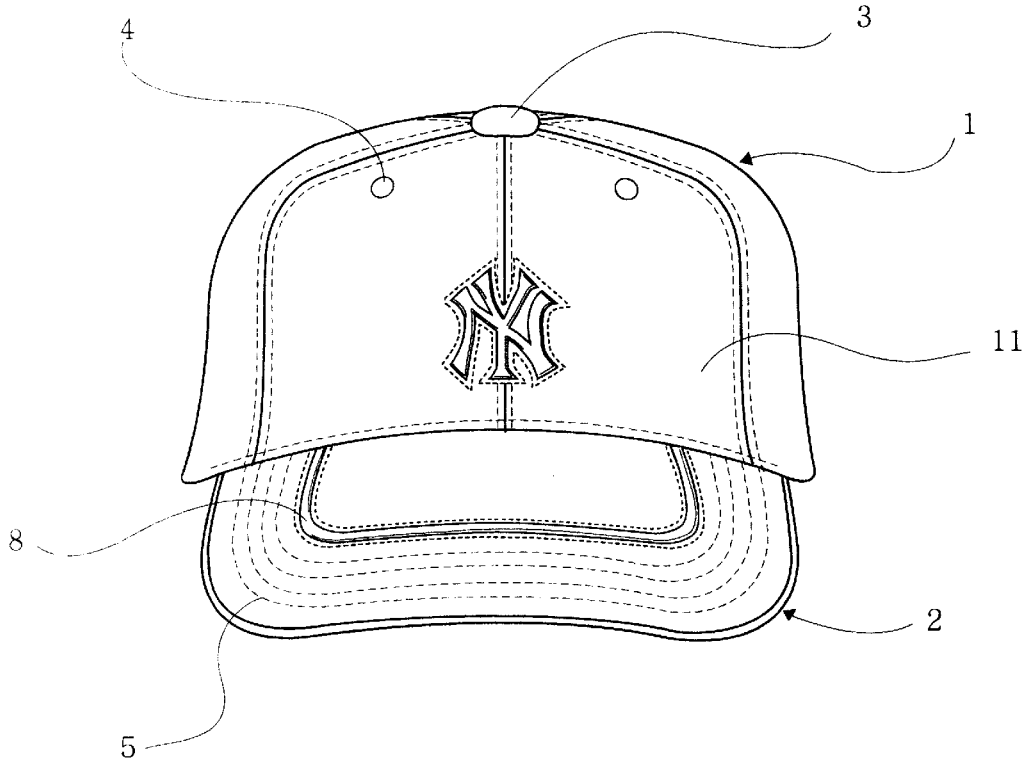
FIG. 1 is a front elevational view of a cap with protrusive effect displaying an increased three dimensional visual effect using two layers of fabric.
Figure 5:
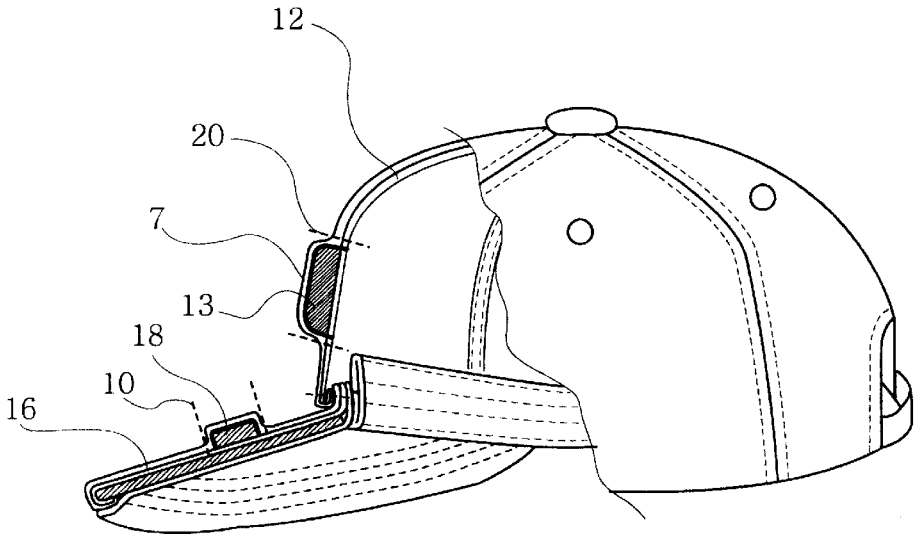
FIG. 5 is a cross-sectional view of a cap with protrusive effect of FIG. 1.

In accordance with the preferred embodiment of the present invention, and with the particular attention directed at FIGS. 1 and 5, at cap with protrusive effect is comprised of a plurality of fabric piece panels forming a crown portion 1 having vent holes 4, and the front panel 11 of the crown portion where the molded letters or diagrams are to be attached having two fabric pieces equal in size adjacent each other. The panels are constructed of a common fabric material or a stretchable fabric. As displayed in the drawings, to present a three dimensional visual effect of letters or diagrams on the front panel 11 of the crown portion 1, a molded material 13 is attached to a fabric piece 12. Another piece of fabric 7 is placed over the fabric piece 12 and stitched along the periphery 20 of molded material 13 with embroidery thread so that the outline of the molded material is effectively exposed in a three dimensional manner. Bill portion 2 includes an upper bill portion 5 having two layers of textile fabric 14, 15 and a rigid peak 16, and a lower bill portion 17. As displayed in FIG. 5, to produce a three dimensional visual effect on the upper bill portion 5 as in the front of the crown portion, a flexible molded material 18 is attached to a piece of fabric 15. Another piece of fabric 14 of the same size is placed over and attached to fabric 15. A three dimensional visual effect is produced by stitching along the periphery 10 of the molded material 18 with embroidery thread so that the outline of the molded material is effectively defined in a three dimensional manner.

A cap constructed in this way is put through a washing process in which the time and temperature of the washing cycle are considered so that the material overlying each protruded molded material of the crown front portion and upper bill portion is decolorized compared to the flat surfaces surrounding the protruded area to produce a natural three dimensional visual effect.

Figure 3:
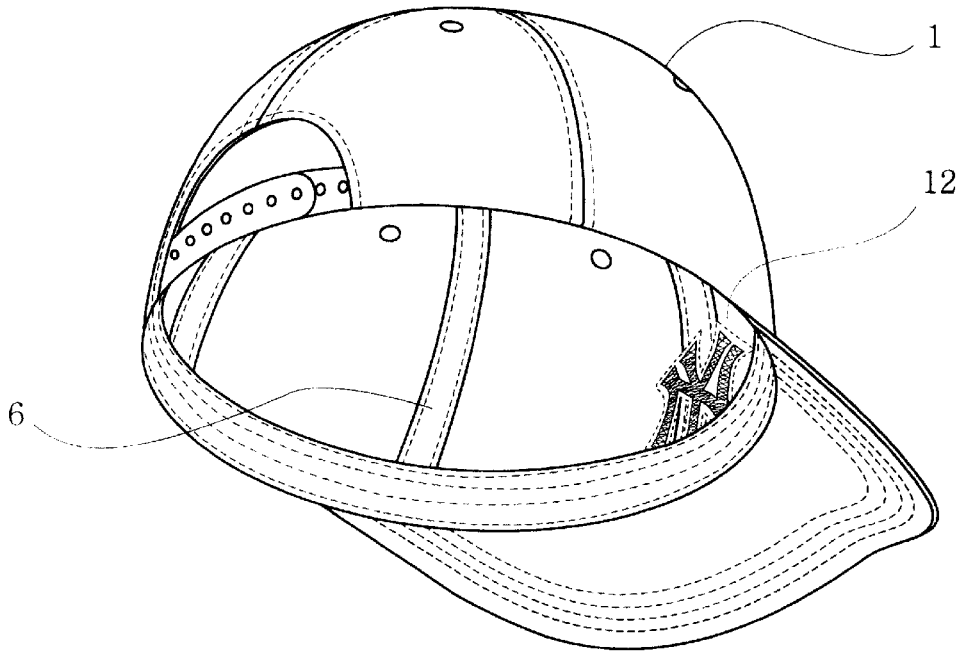
FIG. 3 is a bottom perspective view of a cap with protrusive effect of FIG. 1.

FIG. 3 displays a bottom perspective view showing crown portion 1 constructed with two fabric layers to maximize the three dimensional visual effect of the molded section. As in the diagram, the molded material is stitched to the inside fabric piece 12 of the crown front panel 11. The lower peripheral edge of crown portion 1 is completed by sweatband 9. Reinforce seams 6 join the plurality of fabric piece panels and may be joined at the top with button 3.

Figure 2:
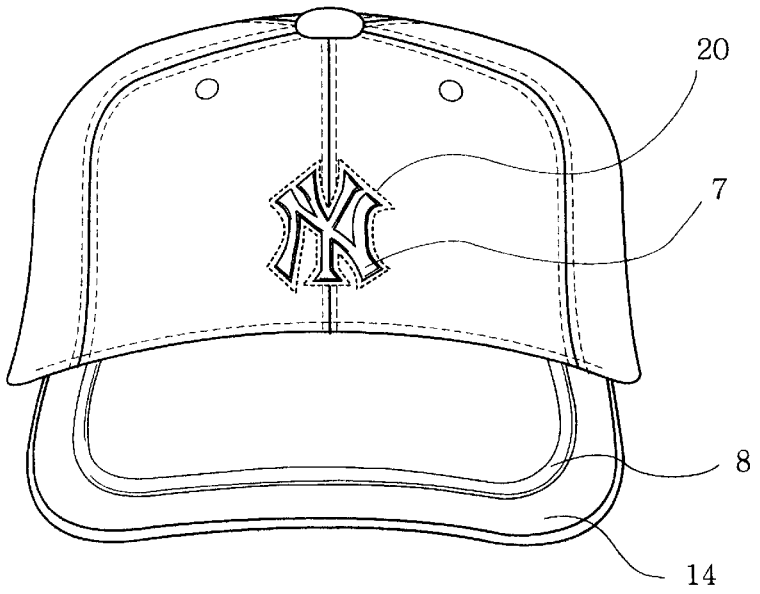
Figure 4:
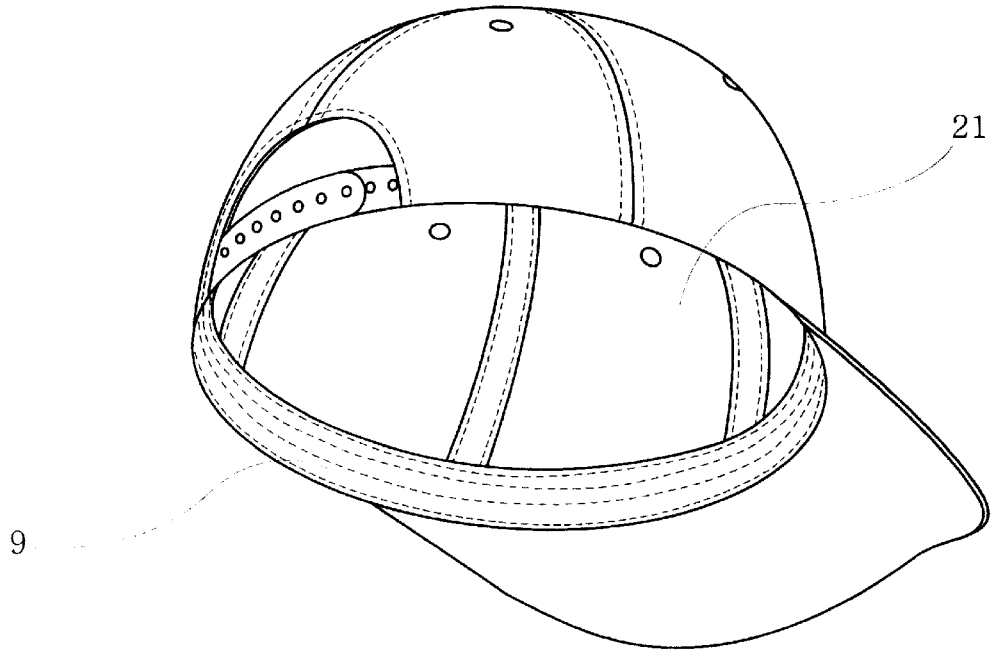
FIG. 4 is a bottom perspective view of a cap with protrusive effect of FIG. 2.
Figure 6:
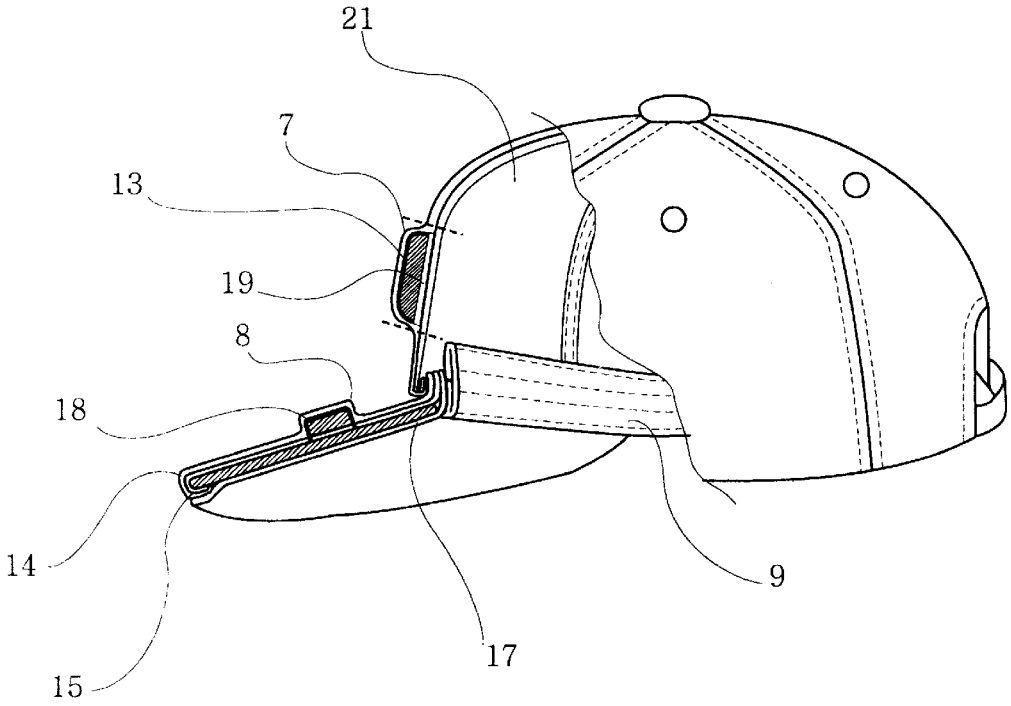
FIG. 6 is a cross-sectional view of a cap with protrusive effect of FIG. 2.

Referring to FIGS. 2 and 6, as an alternative preferred embodiment of the present invention, the molded portion 13 used to display a three dimensional visual effect on crown front panel 11, is attached to either a woven or non-woven material 19. In this instance, the molded portion 13 includes a piece of sheet so that when the molded material is attached to the woven or non-woven material 19, the sheet portion not having embroidery is removed. A piece of fabric 7 equal to the size of the crown front panel 11, is placed on top of the woven or non-woven material on which the molded material is attached. By stitching along the periphery 20 of the molded material, a three dimensional visual effect of the mold outline is effectively displayed. FIG. 4 is a bottom perspective view of FIG. 2 of which a piece of fabric 21 equal to the size of the crown front panel 11, is attached to the inside portion 12 of the front panel 11 so that the embroidered section is not visible.

The same method of construction is applied to the upper bill portion of the headwear piece. A molded portion 18 is attached to a piece of fabric 15 to provide a three dimensional visual effect on the upper bill portion. Another piece of fabric 14 equal in size, is attached on top so that all the layers can be stitched to the lower bill portion fabric material. The upper bill portion may also include molded trim 8 with stitching along its periphery to better define the trim. The molded trim 8 is preferably attached to the piece of fabric 15, overlaid with fabric 14, and stitched.

A cap constructed according to this method is again put through a washing process in the same way as the other preferred embodiments so that a natural three dimensional visual effect of the molded portion is created on the crown front portion and upper bill portion.

In another preferred embodiment of the present invention, a black pigment coating is provided on one side of the fabric material comprising the outer surface of crown portion 1 and bill portion 2. The structure of the headwear piece includes a crown portion comprised of 1 plurality of fabric panels. The front portion of the crown includes two fabric layers, or two fabric layers with one woven or non-woven layer in between the two fabric layers. The fabric material used can be any common textile fabric or stretchable fabric material. The lower peripheral edge of the crown portion is generally completed with a sweat band. The materials used to provide a three dimensional visual effect to the letters or diagrams of a logo, emblem etc. are a flexible molded material or a piece of sheet. The molded portion is attached to the crown front portion and upper bill portion as mentioned above in the preferred embodiments.

A cap constructed in this way is put through a washing process of which the time and temperature of the washing cycle is considered so that the black pigment of the dyed fabric material is appropriately decolorized. When the washing process is completed, the remaining black pigment coating and the original color of the fabric provides an aesthetically pleasing mixed color contrast effect. Especially the protruded molded portions of the crown front panel and upper bill portion are decolorized compared to the surrounding flat surfaces so that a natural three dimensional visual effect is provided.

When selecting the color of the dyed fabric, a variety of colors that have an appropriate contrast effect with the black pigment should be selected so that through a washing process an even improved aesthetically pleasing three dimensional visual effect is provided.

What is claimed is:

1. A cap with protrusive effect comprising:

a main body having a plurality of panels forming a crown portion having a lower peripheral edge, a sweatband attached to the lower peripheral edge of said crown portion to which a bill portion is attached;

a front panel among the plurality of panels, including two pieces of fabric equal in size, an inner piece and an outer piece;

a molded material attached to the inner piece of said two pieces of fabric; and the outer piece overlaying the inner piece and a surface of the crown front panel being stitched along a peripheral outline of the molded material;

wherein, through a washing process the fabric portion is decolorized to enhance a three dimensional visual effect.

2. The cap with protrusive effect as claimed in claim 1, wherein said panels are fabricated by one of common textile fabric and stretchable fabric material.

3. The cap with protrusive effect as claimed in claim 1, wherein said sweatband is fabricated from one of a woven and non-woven material.

4. The cap as claimed in claim 1, further comprising a piece of material in between the two pieces of fabric.

5. The cap as claimed in claim 1, further comprising a molded portion attached to an upper bill portion of said bill portion.

6. The cap with protrusive effect as claimed in claim 1, wherein said molded material includes one of a flexible molded material and a piece of sheet material.

7. The cap with protrusive effect as claimed in claim 5, wherein said upper bill portion is constructed by two pieces of textile fabric.

8. The cap with protrusive effect as claimed in claim 1, wherein said bill portion is comprised of one piece of textile fabric, and a molded material is attached on a peak of said bill.

9. The cap with protrusive effect as claimed in claim 5, wherein said upper bill portion is comprised of two pieces of textile fabric, and a molded material is attached on an inner fabric layer of said upper bill portion.

10. The cap with protrusive effect as claimed in claim 1, wherein a time and temperature of the washing process is considered to effectively display a three dimensional visual effect.

11. A cap with protrusive effect comprising:

a main body having a plurality of panels forming a crown portion fabricated by a dyed textile fabric having a black pigment coating on an outer surface;

a sweatband attached to a lower peripheral edge of said crown portion to which a bill portion is attached;

of the plurality of panels, a crown front panel including two pieces of fabric equal in size;

a first three dimensional molded portion attached to an inner piece of fabric;

an outer surface of the crown front panel being stitched along a peripheral outline of the molded material; and a second three dimensional molded portion being attached to an upper bill portion;

wherein through a washing process the black pigment is decolorized so that remaining black color and an original color of the dyed textile fabric creates a mixed color contrast to effectively provide a three dimensional effect.

12. The cap with protrusive effect as claimed in claim 11, wherein said panels are fabricated by one of common textile fabric and stretchable fabric material.

13. The cap with protrusive effect as claimed in claim 11, wherein said sweatband is fabricated from one of a woven and non-woven material.

14. The cap with protrusive effect as claimed in claim 11, wherein said first three dimensional molded portion includes one of a flexible molded material and a piece of sheet material.

15. The cap with protrusive effect as claimed in claim 11, wherein said upper bill portion is constructed with pieces of textile fabric.

16. The cap with protrusive effect as claimed in claim 15, wherein said upper bill portion is comprised of one piece of textile fabric, and a molded material is attached on a peak of bill.

17. The cap with protrusive effect as claimed in claim 15, wherein said upper bill portion is comprised of two pieces of textile fabric, and a molded material is attached on an inner fabric layer of said upper bill portion.

18. The cap with protrusive effect as claimed in claim 11, wherein a time and temperature of the washing process is considered to effectively display a three dimensional visual effect.

19. A headwear with protrusive effect comprising:

a main body having a plurality of panels forming a crown portion having a lower peripheral edge, a sweatband attached to said lower peripheral edge of said crown portion to which a bill portion is attached;

of the plurality of panels, a front panel includes one of two pieces of fabric equal in size, and two pieces of fabric and one piece of material;

a first three dimensional molded portion attached to one of a piece of said fabric and one piece of said material;

an outer surface of the crown front panel being stitched along a peripheral outline of the molded portion; and a second three dimensional molded material attached to the upper bill portion;

wherein through a washing process the fabric is decolorized to enhance a three dimensional visual effect.

20. The headwear with protrusive effect as claimed in claim 19, wherein said panels are fabricated by one of common textile fabric and stretchable fabric material.

21. The headwear with protrusive effect as claimed in claim 19, wherein said sweatband is fabricated from one of a woven and non-woven material.

22. The headwear with protrusive effect as claimed in claim 19, wherein said first three dimensional molded portion includes one of a flexible molded material and a piece of sheet material.

23. The headwear with protrusive effect as claimed in claim 19, wherein said upper bill portion is constructed by pieces of textile fabric.

24. The cap with protrusive effect as claimed in claim 23, when said upper bill portion is comprised of one piece of textile fabric, and a molded material is attached on a peak of bill.

25. The cap with protrusive effect as claimed in claim 23, when said upper bill portion is comprised of two pieces of textile fabric, and a molded material is attached on an inner fabric layer of upper bill portion.

26. The headwear with protrusive effect as claimed in claim 19, wherein a time and temperature of the washing process is considered to effectively display a three dimensional visual effect.

* * * * *